US006802493B2

(12) United States Patent
Lance

(10) Patent No.: US 6,802,493 B2
(45) Date of Patent: Oct. 12, 2004

(54) MOTORCYCLE LIFT

(76) Inventor: Richard M. Lance, P.O. Box 501, Murrayville, GA (US) 30564

( * ) Notice: Subject to any disclaimer, the term of this patent is extended or adjusted under 35 U.S.C. 154(b) by 120 days.

(21) Appl. No.: 10/225,262

(22) Filed: Aug. 21, 2002

(65) Prior Publication Data

US 2004/0051089 A1 Mar. 18, 2004

(51) Int. Cl.[7] ..... B66F 3/00

(52) U.S. Cl. ..... 254/131; 254/120; 254/8 B; 254/134

(58) Field of Search ..... 254/131, 131.5, 254/133 R, 120, 8 R, 8 B, 134, 113

(56) References Cited

U.S. PATENT DOCUMENTS 4,773,665 A 9/1988 Hindle
D365,534 S 12/1995 Malone et al.
5,732,960 A * 3/1998 Elam ..... 280/79.4
5,971,360 A * 10/1999 Sinsley ..... 254/8 B
6,056,272 A * 5/2000 Sayler ..... 254/131
6,341,763 B1 1/2002 Lefebvre
6,464,207 B2 * 10/2002 Creel et al. ..... 254/131
6,488,157 B2 * 12/2002 Chen ..... 211/20
2002/0063246 A1 * 5/2002 Bevre ..... 254/131

* cited by examiner

*Primary Examiner*—Lee D. Wilson

(57) ABSTRACT

A motorcycle lift [100] comprises two lift arms [103A, 103B] attached to a cross bar [105]. Support sleeves [109A, 109B] attached to the ends of the lift arms surround the foot pegs [150A, 150B] of the motorcycle [301] to securely engage the vehicle. Clamps [125A, 125B] provide a means to adjust the width between the support sleeves for engagement to the foot pegs. A lever [107] attached to the cross bar raises and lowers the motorcycle. Replaceable sleeves [109A, 109B] allow relatively tight diametrical clearance with various foot peg designs to provide stable support. The design allows stable support even with foot pegs of folding designs.

19 Claims, 5 Drawing Sheets

MOTORCYCLE LIFT

FIELD OF THE INVENTION

The present invention relates to motorcycle lifts and, more particularly, to motorcycle lifts engaging the foot pegs of the motorcycle.

BACKGROUND OF THE INVENTION

A frequent need exists to raise a portion of a motorcycle for maintenance, repair or testing. For example, maintenance or repair to the wheels or tires, frame, engine, transmission, brakes and exhaust systems are performed more quickly and efficiently if there is a method to safely and reliably lift all or part of the motorcycle from a supporting surface such as the floor of a garage or workshop.

A number of devices have been disclosed to lift the motorcycle from a support surface. For example, a lever-action vehicle lift is disclosed in U.S. Pat. No. 6,341,763. This patent discloses a number of methods in which to engage various components of the motorcycle. Different engagement devices are shown to use on different components of the motorcycle. The very fact that various configurations of a lift are needed for use with different motorcycle designs shows a limitation of current devices.

Another problem with lifts in current use is poor stability of the motorcycle when lifted from the support surface. Engagement apparatus of the lift which merely support a component of the motorcycle are unlikely to offer stable support if the motorcycle is disturbed, or weight shifts during use.

Still other vehicle lifts that may be used with motorcycles are very complicated, and often expensive.

An improved motorcycle lift is needed which addresses the limitations of current devices.

OBJECTS AND SUMMARY OF THE INVENTION

Therefore, an object of the present invention is to provide a motorcycle lift that engages the foot pegs of a motorcycle to perform a lift from a support surface.

Another object of the present invention is to provide a motorcycle lift that accommodates various foot peg designs and sizes.

Still another object of the present invention is to provide a motorcycle lift that provides stable support from the foot pegs of a motorcycle, even if the foot pegs are of a hinged or folding design.

Yet another object of the present invention is to provide a motorcycle lift that can be used from either side of the motorcycle.

Another object of the present invention is to provide a motorcycle lift that provides stable support for the motorcycle even if the motorcycle is disturbed, or weight shifts on the motorcycle.

Yet another object of the present invention is to provide a motorcycle lift that provides a means to adjust the height of the lift.

Another object of the present invention is to provide a motorcycle lift that provides a means to adjust the width between the foot peg encapsulation on either side of the motorcycle.

Still another object of the present invention is to provide a motorcycle lift that is simple and low in cost.

The motorcycle lift comprises two lift arms attached to a cross bar. The ends of the lift arms comprise support sleeves that enclose or encapsulate the foot pegs on either side of the motorcycle with a sufficiently tight diametrical clearance and a sufficient length such that the motorcycle is supported in a stable configuration. A lever attachable to either end of the cross bar rotates the lift arms about pivot feet to raise the motorcycle. The lift arms are adjustable along the cross bar to engage the foot pegs, and for use with various motorcycle designs.

The lift arms comprise engagement pins or other mechanical fasteners to adjust the length of the lift arms and allow adjustment of the height of the lift. The lever comprises a height adjustment to ensure the lever is supported in a stable configuration, and to provide minor height adjustment once the motorcycle is in a lifted condition.

The diametrical clearance between the support sleeves and the foot peg outer diameter, and a sufficiently long sleeve provides stable support from the foot peg, even if the foot peg is of a folding design, or if the motorcycle is disturbed or weight shits occur during maintenance. The support sleeve may be integral to the ends of the lift arms, or they may be replaceable sleeves of a polymeric material to protect the foot pegs from abrasion damage. Use of replaceable sleeves allows quick change of sleeves to accommodate different diameter motorcycle foot pegs.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a motorcycle lift utilizing the foot pegs of a motorcycle for stable lifts.

Figure 1A:
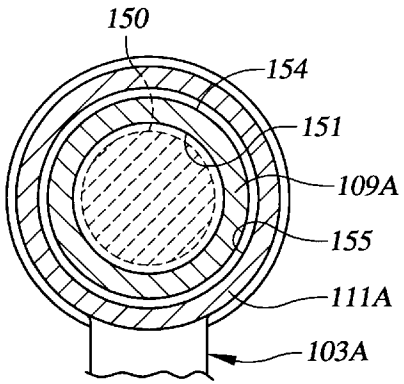
FIG. 1A is a cross section detail drawing of a peg support taken through lines 1A—1A of FIG. 1 showing a support sleeve enclosing a foot peg shown in phantom lines.
Figure 1B:
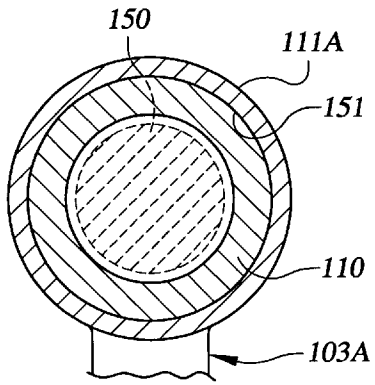
FIG. 1B is a cross section detail drawing of an alternative embodiment of the peg support having the support sleeve bonded to the sleeve attachment portion.
Figure 1:
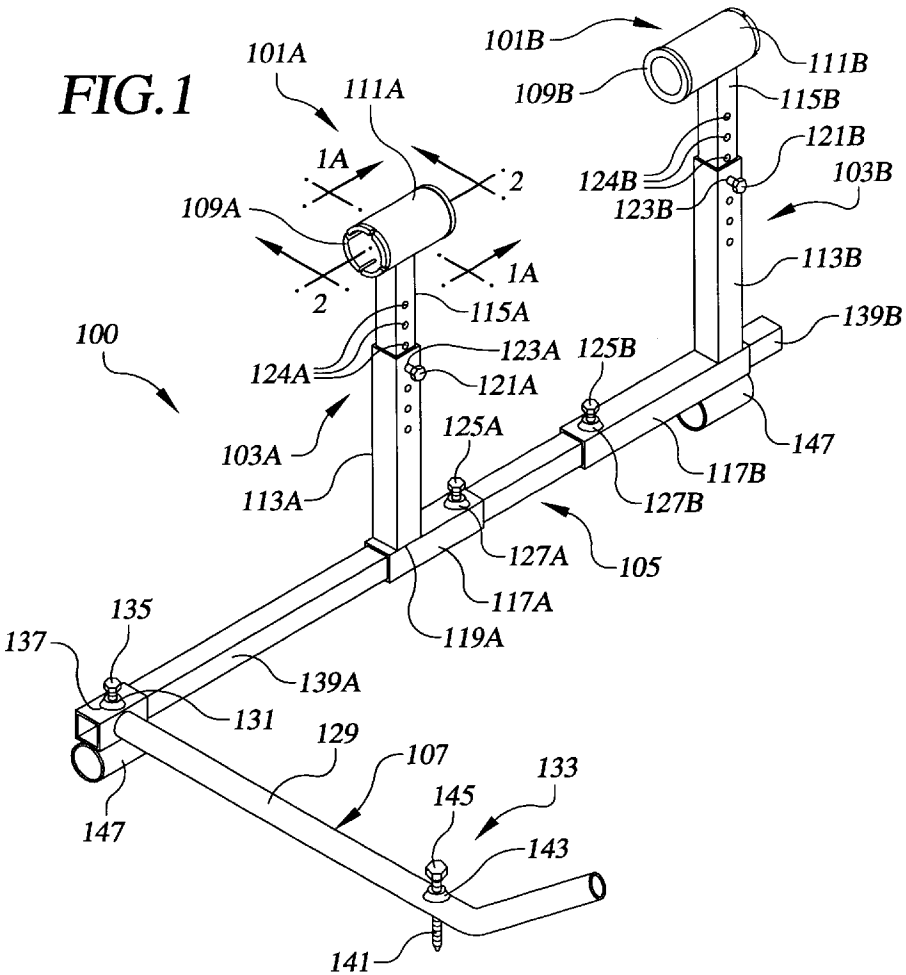
FIG. 1 is perspective drawing of a preferred embodiment 100 of the motorcycle lift showing lift arms attaching two peg supports to a crossbar of the lift, and a lever attached to one end of the crossbar.

FIG. 1 is a perspective drawing of embodiment 100 of the motorcycle lift comprising first peg support 101A, second peg support 101B, first lift arm 103A, second lift arm 103B crossbar 105, and lever 107. First lift arm 103A and second lift arm 103B connect respective peg supports 101A, 101B to crossbar 105 so that the lift arms are generally perpendicular to crossbar 105. Lever 107 is fastened to crossbar 105 so that it is generally perpendicular to the plane of lift arms 103A, 103B, and crossbar 105. In the preferred embodiments, crossbar 105 is a rectangular tube of steel construction. The first lift arm and peg support components are described below. The respective second lift arm and peg support components are similar to the first lift arm and peg support components.

First peg support 101A comprises a peg support sleeve 109A enclosed by a sleeve attachment portion 111A. In the preferred embodiments, sleeve attachment portion 111A is a tube or cylinder totally enclosing respective sleeve 109A.

In the preferred embodiments, first lift arm 103A comprises a base portion 113A, slide post 115A, and adjustable base sleeve 117A. Base portion 113A and slide post 115A are rectangular tubes sized so that slide post 115A slides into base portion 113A with a loose or sliding fit. An attachment means such as weld 119A attaches base portion 113A to base sleeve 117A. A height adjustment means such as pin 121A, insertable through hole 123A of base portion 113A and one of a plurality of holes 124A of slide post 115A, allows quick adjustment of the length of lift arm 103A. Other height adjustment means, such as clamp bolts, through bolts, clamp bands, turn bolts, eccentric cams and other mechanical adjusting means may be utilized.

Adjustable base sleeve 117A is a rectangular tube selected to provide a sliding fit with crossbar 105. In the preferred embodiments, a width adjusting means, such as clamp bolt 125A threaded into boss 127A of adjustable sleeve 117A, allows adjustment of sleeve 117A longitudinal position along crossbar 105 when clamp bolt 125A is loosened. Tightening clamp bolt 125A clamps base portion 117A in the desired position. In other embodiments, other width adjustment means, such as hole and pin designs, through bolts, clamp bands, turn bolts and other mechanical adjusting means may be utilized.

Lever 107 comprises lever arm 129, lever engagement element 131, and lever height adjustment means 133. In the preferred embodiment, lever engagement element 131 is a sleeve selected for a sliding fit on crossbar 105. Clamp bolt 135, threaded in boss 137 of element 131 allows longitudinal adjustment of lever 107 position along crossbar 105, and clamping in the desired position. Lever engagement element 131 also allows engagement with first end 139A or second end 139B of crossbar 105. Other lever engagement and adjustment means may be used such as socket engagement, slot engagement, and use of various mechanical fasteners.

In the preferred embodiments, lever height adjustment means 133 comprises a height adjustment screw 141 threaded in threaded hole or boss 143 on the outboard end of lever 107. Knob or head 145 allows easy adjustment of screw 141.

Figure 3:
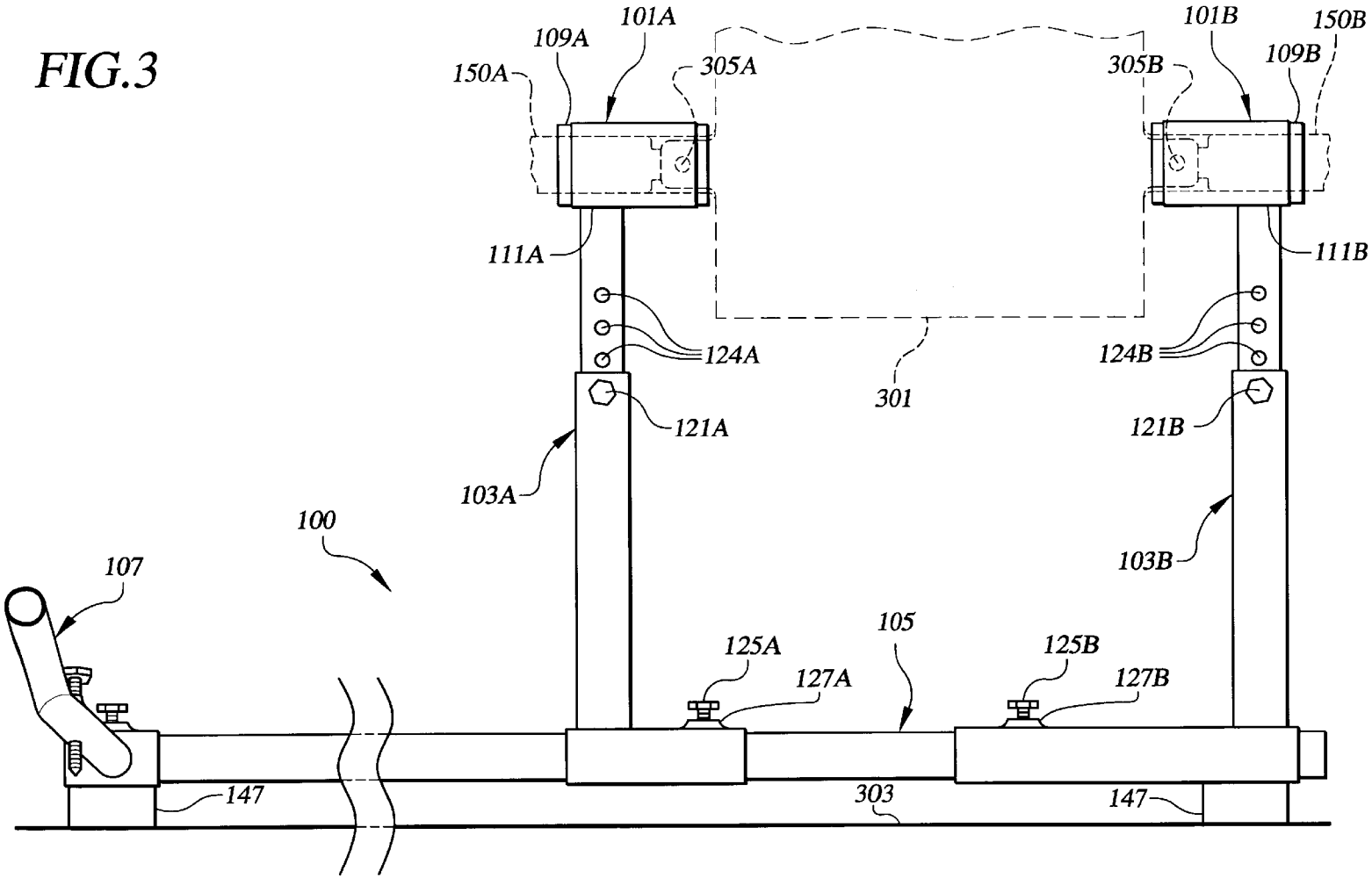
FIG. 3 is a front elevation drawing of lift 100 showing encapsulation of folding foot pegs and motorcycle 301 in the lifted condition.

Pivot feet 147 attached to the bottom portion of crossbar 105 provide pivot support to cross bar 105 from a supporting surface (303 of FIG. 3). In the preferred embodiments, pivot feet 147 are tubes welded to the crossbar side opposite lift arms 103A and 1103B.

FIG. 1A is a cross section detail drawing of peg support 101A taken through lines 1A—1A of FIG. 1. A foot peg 150 inserted into peg support 101A is shown in phantom lines. The diameter of inner diameter or aperture 151 of sleeve 109A is chosen to provide a loose or sliding fit with the outer diameter of foot peg 150. Sleeve 109A encloses and preferably totally encloses foot peg 150 to provide stable support for the motorcycle when it is lifted by lift 100. Surprisingly, it has been found that a small diametrical clearance between the outer diameter of foot peg 150 and the inner diameter or aperture 151 of peg support sleeve 109A and a relatively long sleeve length provides stable support of the motorcycle, even if the peg is a folding-type foot peg. A minimum diametrical clearance, preferably at least a sliding fit, facilitates insertion of foot peg 150 into sleeve 109A and allows rotation between foot peg 150 and sleeve 109A when the motorcycle is raised or lowered.

In a similar manner, sleeve attachment portion 111A attaches sleeve 109A to lift arm 103A. In the preferred embodiment, sleeve attachment portion 111A encloses and, preferably totally encloses sleeve 109A. A sliding fit diametrical clearance between the outer barrel diameter (surface 154) of sleeve 109A and the inner diameter or aperture 155 of sleeve attachment portion 111A allows easy insertion and removal of sleeve 151.

FIG. 1B shows an alternative embodiment of peg support 101A showing support sleeve 110 bonded to sleeve attachment portion 111A. Bonding may be by adhesives, or by interference fit, or sleeve 110 may be a coating bonded to aperture 151 of sleeve attachment portion 111A. Diametrical clearances between foot peg 150 and peg support sleeve 110 are similar to those described in FIG. 1A. In the preferred embodiments, sleeve 110 is made of a polymeric material such as PVC, PE, PA, PI, or ABS, preferably of a material having a hardness less than structural components such as sleeve attachment portion 111A. Coating materials which may be used to form sleeve 110 include polymers such as epoxies, other thermo sets, or thermoplastics. High density, high-strength foamed polymers may also be used. The polymeric material is chosen to provide abrasion protection to foot peg 150.

Figure 2:
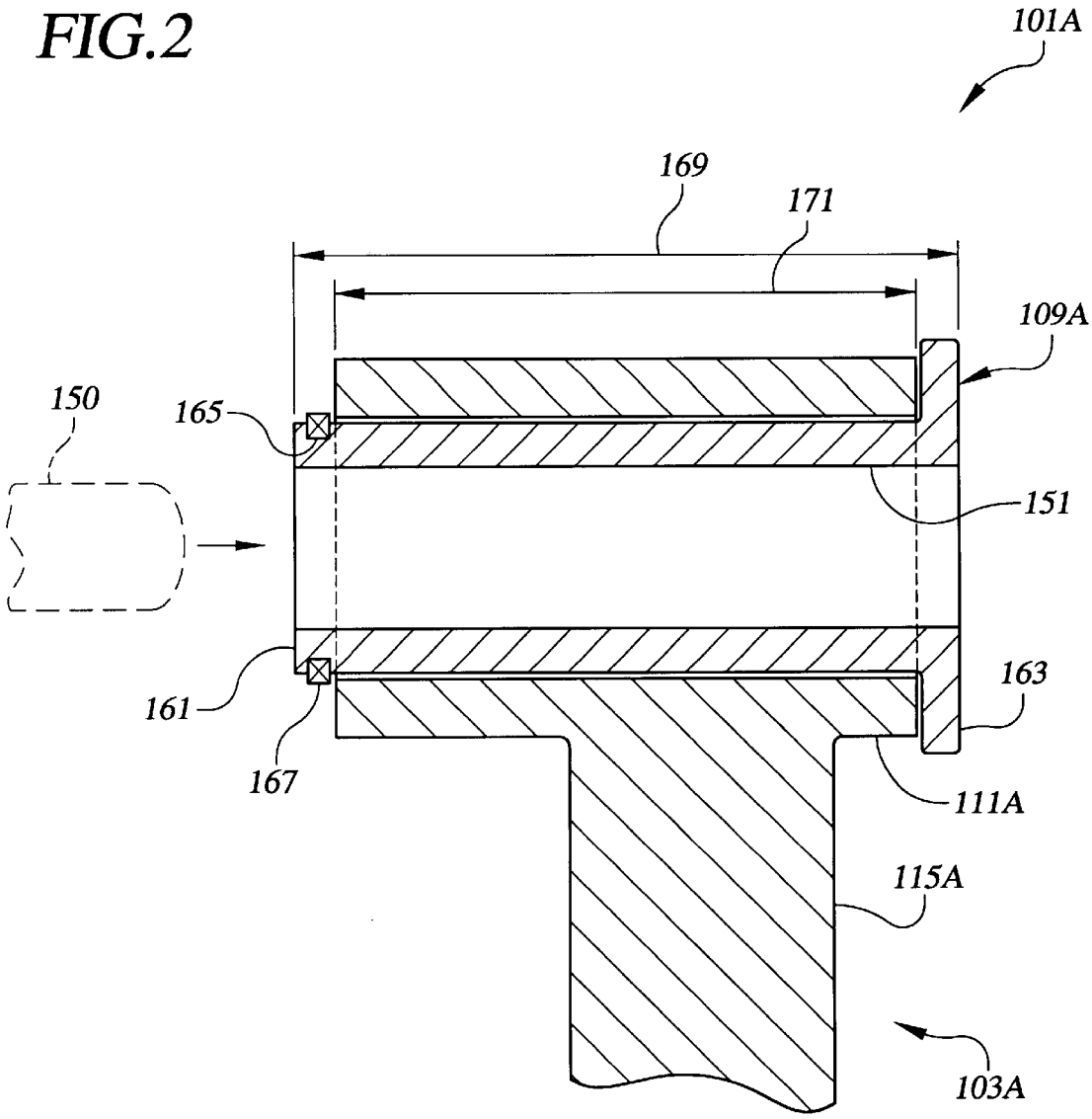
FIG. 2 is a cross section detail drawing of a peg support taken through lines 2—2 of FIG. 1 showing attachment of the support sleeve in the sleeve attachment portion.

FIG. 2 is a cross-sectional drawing of peg support 101A taken through lines 2—2 of FIG. 1. Sleeve attachment portion 111A encloses and supports peg support sleeve 109A. Sleeve 109A comprises body portion 161, flange portion 163, and groove 165. Flange portion 163 and snap ring 167 retain sleeve 109A in sleeve attachment portion 111A. Snap ring 167 serves as releasable retainer means to allow quick removal and installation of a new or different sleeve in sleeve attachment portion 111A.

Adequate sleeve length 169 and limited diametrical clearance between peg 150 diameter and sleeve aperture 151 diameter as shown in FIGS. 1A and 1B are especially important for use with folding foot peg designs. In the preferred embodiments, sleeve length 169 is at least 1.5". In the more preferred embodiments, sleeve length 169 is at least 2". In the still more preferred embodiments, sleeve length 169 is at least 3". In the most preferred embodiments, sleeve length 169 is at least 4". Sleeve length 169 is preferably at least 50%, more preferably 75%, and most preferably 90% or more of the length of foot peg 150.

Sleeve attachment portion length 171 must be sufficient to provide adequate support of sleeve 109A and is preferably at least 50%, more preferably at least 75%, and most preferably at least 90% of the length of the sleeve 109A. In embodiments not utilizing a separate sleeve 109A, the length and diametrical clearances of attachment portion 111A should meet the requirements of sleeve 109A.

In the preferred embodiments, the diametrical clearance between the inner diameter of sleeve 109A and the outer diameter of foot peg 150 is less than 0.5". In the more preferred embodiments, the diametrical clearance is less than 0.25", and in the most preferred embodiments, the diametrical clearance is less than 0.125". Small diametrical clearance is most important when the lift is used on motorcycles with folding type foot pegs.

Peg support 101A may accommodate different foot peg sizes by substitution of a support sleeve 109A with aperture 151 diameter chosen to meet the diametrical clearance requirements of FIGS. 1A and 1B. In the preferred embodiments, sleeve 109A is made of a polymeric material with a hardness less than the structural components such as sleeve attachment portion 111A or lift arm 103A and foot peg 150 to prevent abrading or scratching foot peg 150.

In the preferred embodiments, the structural components of lift 100 including lift arms 103A, 103B, crossbar 105, and lever 107, are made of structural steel shapes such as steel tubes. Other structural materials and shapes may be used such as aluminum, stainless steel, or high strength plastics. In the preferred embodiments, sleeve attachment portions 111A, 111B are made of steel tube.

FIG. 3 is a front elevation drawing of a motorcycle 301 being supported in a lifted condition from support surface 303 by lift device 100. Sleeves 109A and 109B of peg supports 101A and 101B support folding foot pegs 150A and 150B. Meeting the adequate length and diametrical clearance requirements of FIGS. 1A, 1B, and 2 allows stable support of motorcycle 301 by foot pegs 150A and 150B, even though the foot pegs are foldable, such as by hinges 305A and 305B.

Figure 4:
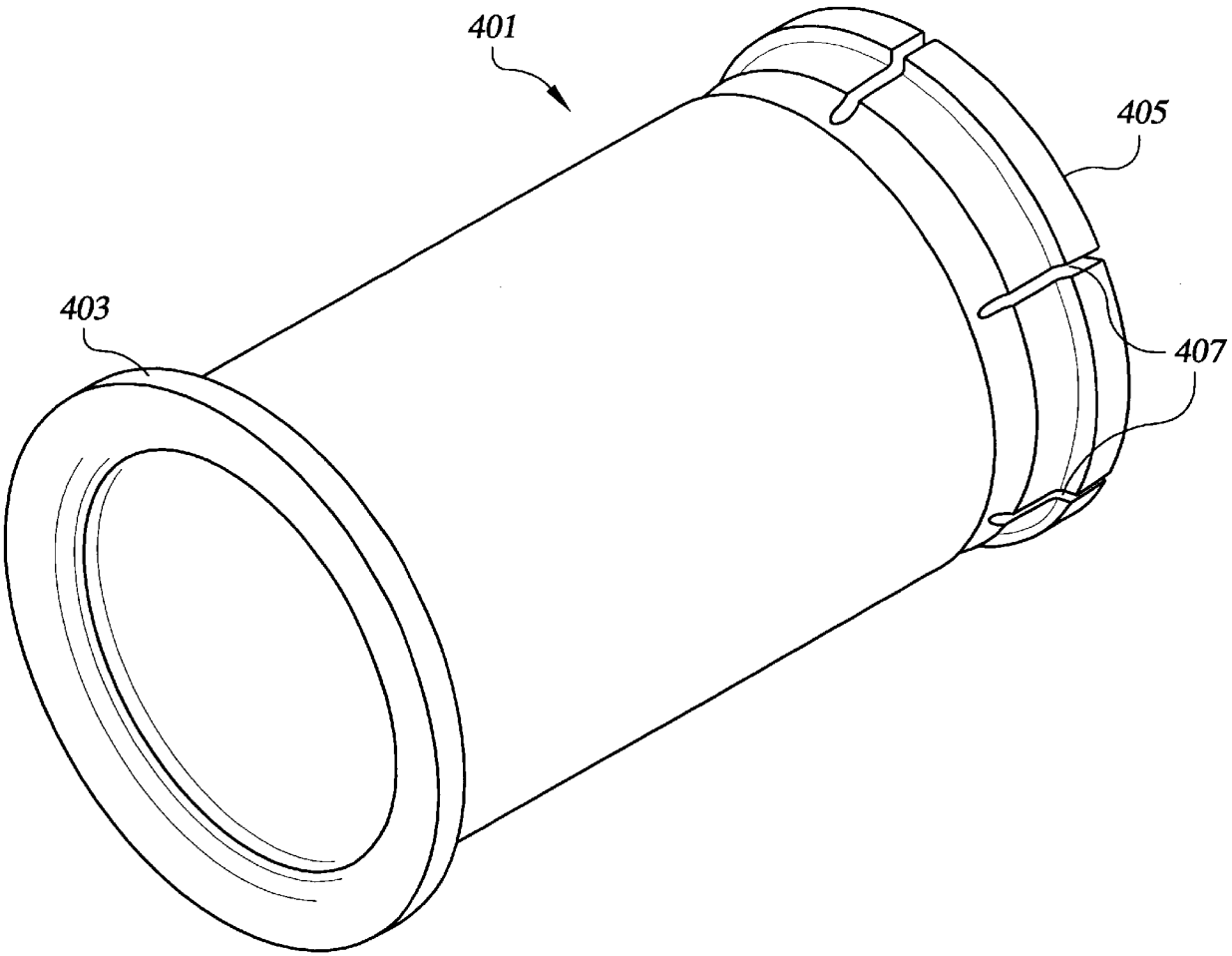
FIG. 4 is an alternative embodiment of the peg support sleeve having a resilient flange for convenient insertion and removal from the lift.

FIG. 4 is a perspective drawing of another embodiment 401 of peg support sleeve 109A. Flange 403 provides a retaining means at one end of sleeve attachment portion 111A, 111B, and spring flange 405 provides a releasable retaining means at a second end of the sleeve attachment portions. Slots 407 provide resilience to flange 405 and allow sleeve 401 to be snapped into aperture 151 of the sleeve attachment portion.

Figure 5A:
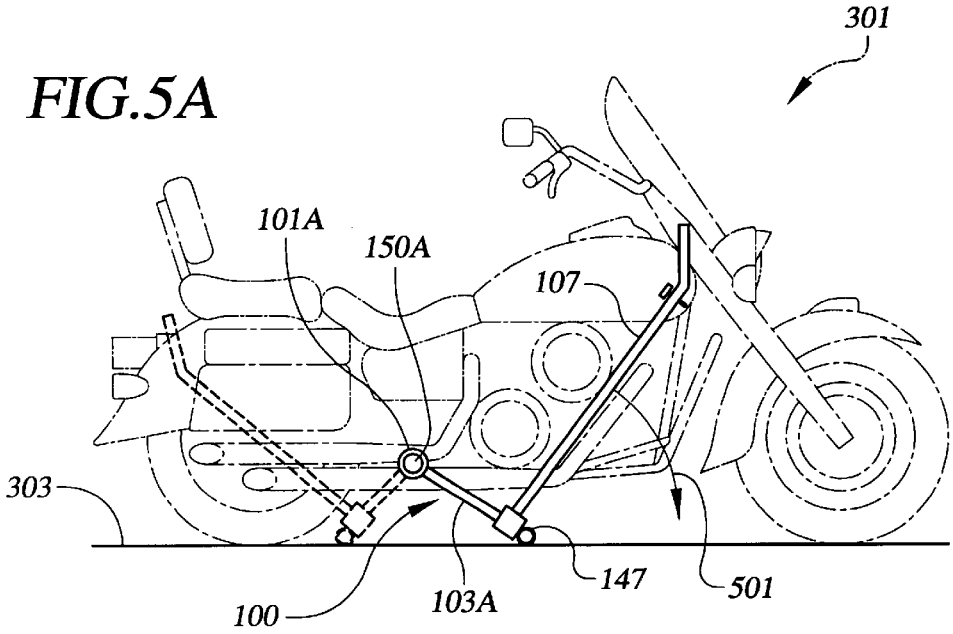
FIG. 5A is a side elevation drawing of lift 100 positioned under a motorcycle and engaged to the foot pegs.
Figure 5B:
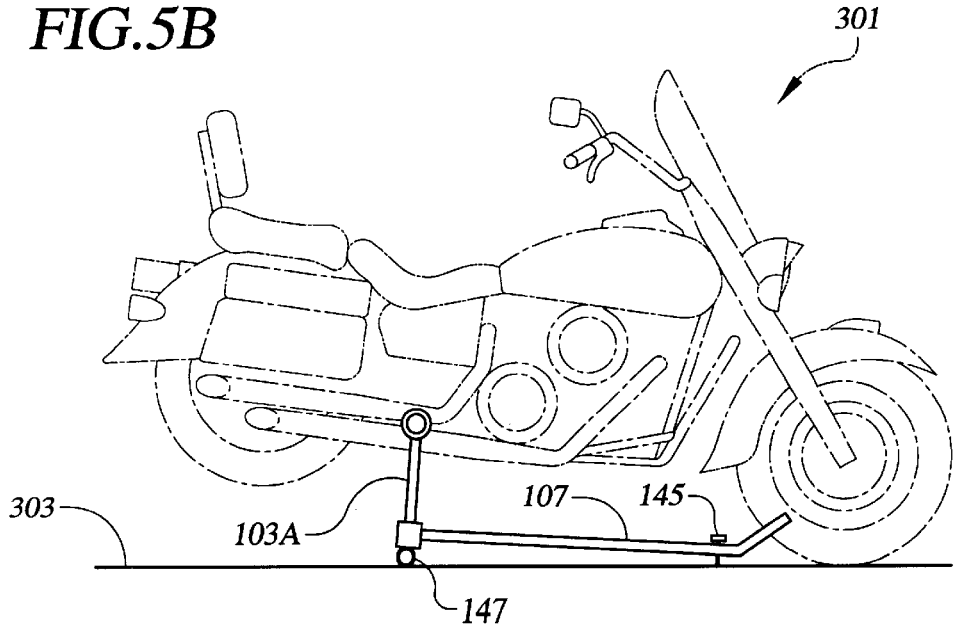
FIG. 5B is a side elevation drawing of lift 100 in which the lever has been rotated to lift the motorcycle in a raised position.

FIG. 5A is a side elevation drawing showing employment of lift 100 for lifting motorcycle 301. Before attaching lift 100, at least one of the clamp bolts 125A, 125B (FIG. 1) are loosened and one or both lift arms 103A, 103B adjusted outward to allow insertion of foot pegs 150A, 150B (only one side is shown, the back side is similar). The lift arms are adjusted inwardly until foot pegs 150A, 150B are fully enclosed as shown in FIG. 3, and the respective clamp bolts 125A, 125B are tightened. Optionally lift arm 103A, 103B lengths are adjusted by removal of lock pins 121A, 121B (FIG. 1) and re-secured in the desired holes 124A, 124B to provide the desired lift height. Rotating lever arm 107 in the direction of arrow 501 rotates lift arms 103A and 103B about pivot foot 147 and raises foot pegs 150A and 150B to raise motorcycle 301 from supporting surface 303 in the raised position of FIG. 5B. Lever height adjustment knob 145 may be used to adjust height of lever 107 to ensure adequate rotation about pivot foot 147 to ensure stability, and to provide a fine height adjustment for motorcycle 301.

Lowering motorcycle 301 is performed by reversing the lift procedure. Lever 107 is rotated in a direction opposite from arrow 501 to lower the vehicle to support surface 303. The clamp bolt of at least one lift arm is loosened to allow removal of peg supports 101A and 101B from foot pegs 150A and 150B. Lift 100 may be used from either side of motorcycle 301, or the device may be used in a mirror-image location as shown in the phantom lines of FIG. 5A Accordingly, the reader will see that MOTORCYCLE LIFT provides a quick and secure method to raise a motorcycle. The device provides the following additional advantages:

The lift can be used with virtually any motorcycle;

The lift can be used with motorcycles having foot pegs which fold;

Quick-change sleeves allow proper fit with virtually any foot peg design;

Full encapsulation of the foot pegs provides stability even upon upset;

The lift can be reversed or used from either side of the motorcycle; and

The lift is simple and low in cost.

Although the description above contains many specifications, these should not be construed as limiting the scope of the invention but merely providing illustrations of some of the presently preferred embodiments of this invention. For example, the peg support sleeve may be connected directly to the lift arm so that the sleeve attachment portion is a simple fastening method such as welding or use of mechanical fasteners. Or, a separate support sleeve may be omitted and the dimensions of sleeve attachment portions 111A, 111B may be adjusted to the requirements of the invention. Or, the sleeve attachment portions may be rectangular tubes and the support sleeves comprising a similar cross-sectional shape on their outer diameters. Thus the scope of the invention should be determined by the appended claims and their legal equivalents, rather than by the examples given.

I claim:

1. A lift for engaging the foot pegs of motorcycles, the lift comprising:

a cross bar comprising a lever fixed to a first end portion of the crossbar;

a first lift arm generally perpendicular to the crossbar comprising a first end attachable and detachably connected to the cross bar and a second end comprising a first peg support;

a second lift arm generally perpendicular to the crossbar comprising a first end attachable and detachably connected to the cross bar and a second end comprising a second peg support;

the first peg support comprising a sleeve portion, the sleeve portion comprising a first aperture and fully surrounding a foot peg of a motorcycle when inserted into the sleeve portion wherein said first end attachable and detachably connected of the first lift arm is an adjustable sleeve including a means for locking and said first end attachable and detachably connected of the second lift arm is an adjustable sleeve including a means for locking.

2. The lift of claim 1 wherein first peg support comprises a sleeve attachment portion attached to the second end of the first lift arm, the sleeve attachment portion comprising a second aperture fully surrounding the sleeve portion.

3. The lift of claim 2 wherein the sleeve portion is made of a first material and the sleeve attachment portion is made of a second material, the first material being softer than the second material.

4. The lift of claim 2 wherein the sleeve portion is a cylinder insertable in the second aperture of the of the sleeve attachment portion.

5. The lift of claim 4 wherein the sleeve portion is made of a polymeric material.

6. The lift of claim 2 wherein the second aperture of the sleeve attachment portion defines a first inner diameter and the sleeve portion comprises a polymeric coating on the first inner diameter.

7. A lift for engaging the foot pegs of motorcycles, the lift comprising:

a cross bar comprising a lever attachable and detachably connected to a first end portion of the crossbar;

a first lift arm generally perpendicular to the crossbar comprising a first end including a means for adjusting a longitudinal position along the cross bar attachable and detachably connected to the cross bar and a second end comprising a first peg support;

a second lift arm generally perpendicular to the crossbar comprising a first end attachable and detachably connected to the cross bar and a second end comprising a second peg support;

the first peg support comprising a first aperture and fully surrounding a foot peg of a motorcycle when inserted into the sleeve portion;

wherein the first peg support comprises a length of at least two inches.

8. The lift of claim 7 wherein the first peg support comprises a length of at least 3".

9. The lift of claim 7 wherein the first peg support comprises a length of at least 4".

10. The lift of claim 7 wherein the first aperture of the first peg support comprises a diametrical clearance of less than 0.5" with an outer diameter of the foot peg.

11. The lift of claim 7 wherein the first aperture of the first peg support comprises a diametrical clearance of less than 0.25" with an outer diameter of the foot peg.

12. The lift of claim 7 wherein the first aperture of the first peg support comprises a diametrical clearance of less than 0.125" with an outer diameter of the foot peg.

13. The lift of claim 7 wherein the first lift arm comprises a means for adjusting the length of the lift arm.

14. The lift of claim 7 wherein the lever comprises a means for adjusting the height of the lever arm above a support surface.

15. The lift of claim 7 wherein the lift comprises a means for attaching the lever to a first end of the cross bar and a second end of the cross bar.

16. A method for raising a motorcycle from a supporting surface with a lift, the lift comprising a first peg support sleeve and a second peg support sleeve attached to a crossbar by a first lift arm and a second lift arm, the method comprising the steps:

enclosing first foot peg of the motorcycle with the first peg support sleeve of the lift wherein the first peg support sleeve encloses the first foot peg;

enclosing a second foot peg of the motorcycle with the second peg support sleeve of the lift wherein the second peg support sleeve encloses the second foot peg; and rotating a lever attached to a first end of the crossbar to raise the motorcycle from the supporting surface.

17. The method of claim 16 the first foot peg comprises a first outer diameter and the first peg support sleeve comprises a first inner diameter, the first outer diameter and the first inner diameter defining a diametrical clearance less than 0.5" and the first peg support sleeve length is at least 1.5".

18. The method of claim 16 wherein the first foot peg comprises a first outer diameter and the first peg support sleeve comprises a first inner diameter, the first outer diameter and the first inner diameter defining a diametrical clearance less than 0.5" and the first peg support sleeve length is at least 2".

19. The method of claim 16 where first foot peg comprises a first outer diameter and the first peg support sleeve comprises a first inner diameter, the first outer diameter and the first inner diameter defining a diametrical clearance less than 0.25" and the first peg support sleeve length is at least 3".

* * * * *